US012157975B2

(12) United States Patent
Prescott et al.

(10) Patent No.: US 12,157,975 B2
(45) Date of Patent: Dec. 3, 2024

(54) CONTROLLING THE SLICE FLOW OF A SLURRY THROUGH A HEADBOX

(71) Applicant: ANDRITZ INC., Alpharetta, GA (US)

(72) Inventors: Ralph Prescott, Roscoe, IL (US); Jay Shands, Navarre, FL (US)

(73) Assignee: ANDRITZ INC., Alpharetta, GA (US)

( * ) Notice: Subject to any disclaimer, the term of this patent is extended or adjusted under 35 U.S.C. 154(b) by 136 days.

(21) Appl. No.: 17/910,344

(22) PCT Filed: Apr. 9, 2021

(86) PCT No.: PCT/US2021/026617
§ 371 (c)(1),
(2) Date: Sep. 8, 2022

(87) PCT Pub. No.: WO2021/207626
PCT Pub. Date: Oct. 14, 2021

(65) Prior Publication Data

US 2023/0160144 A1 May 25, 2023

Related U.S. Application Data

(60) Provisional application No. 63/007,693, filed on Apr. 9, 2020.

(51) Int. Cl.
*D21G 9/00* (2006.01)
*D21F 1/02* (2006.01)

(52) U.S. Cl.
CPC ..... *D21G 9/0018* (2013.01); *D21F 1/02* (2013.01)

(58) Field of Classification Search
CPC .... G06F 9/442; D21G 9/0018; D21G 9/0027; D21F 1/02
See application file for complete search history.

(56) References Cited

U.S. PATENT DOCUMENTS 4,086,130 A 4/1978 Justus
4,526,653 A 7/1985 Andersson
(Continued)

FOREIGN PATENT DOCUMENTS

DE 19905543 A1 * 9/1999 ..... D21F 1/02

OTHER PUBLICATIONS

English translation of DE19905543A1 supplied by Espacenet. (Year: 2024).*

(Continued)

*Primary Examiner* — Jacob T Minskey
*Assistant Examiner* — Elisa H Vera
(74) *Attorney, Agent, or Firm* — Kilpatrick Townsend & Stockton LLP

(57) ABSTRACT

A method for controlling a slice flow of a slurry having two or more component slurries through a headbox for a paper making machine includes, inputting a wire speed of the paper making machine; determining a jet velocity setpoint based on the wire speed; determining a header pressure setpoint for two or more headers to generate the jet velocity determined by the jet velocity setpoint, each header providing one of the two or more component slurries to the headbox; and controlling the slice flow by: generating a first speed command to a first slurry pump to generate a header pressure determined by the header pressure setpoint in a first header; and generating a second speed command to a second slurry pump to generate the header pressure determined by the header pressure setpoint in a second header.

17 Claims, 7 Drawing Sheets

(56) References Cited

U.S. PATENT DOCUMENTS

| | | | | |
|---|---|---|---|---|
| 4,888,094 | A * | 12/1989 | Weisshuhn | D21F 1/02 162/336 |
| 6,355,142 | B1 | 3/2002 | Ahrens | |
| 2009/0071666 | A1 * | 3/2009 | Ehrhart | A01B 63/1013 172/1 |

OTHER PUBLICATIONS

Merriam-Webster, Nozzle, Mar. 11, 2024, url: https://www.merriam-webster.com/dictionary/nozzle (Year: 2024).*

European Application No. 21722704.0, Office Action mailed on Jun. 12, 2023, 3 pages.

International Application No. PCT/US2021/026617, International Preliminary Report on Patentability mailed on Oct. 20, 2022, 8 pages.

European Application No. 21722704.0, Intention to Grant mailed on Mar. 6, 2024, 9 pages.

International Patent Application No. PCT/US2021/026617, International Search Report and Written Opinion, Jul. 13, 2021, 10 pages.

* cited by examiner

400

| Functions | | | | | Loops/Equipment | |
|---|---|---|---|---|---|---|
| PIC | Pressure | Indicating | Controller | | A, B | Flow Loop A or B |
| PH | Pressure | Calculation | | | Ahh, Bhh | Inlet Header A or B |
| PT | Pressure | Transmitter | | | | |
| PY | Pressure | Calculation | | | AR | Flow Loop A Return |
| | | | | | BR | Flow Loop B Return |
| FI | Flow | Indicator | | | FM | Flexible Membrane |
| FT | Flow | Transmitter | | | Gap | Nozzle Opening |
| FV | Flow | Valve | | | HA | Header A |
| FY | Flow | Calculation | | | HB | Header B |
| | | | | | N | Nozzle |
| HIC | Hand | Indicating | Controller | | | |
| | | | | | | |
| SC | Speed | | Controller | | TG | Turbulence Generator |
| SI | Speed | Indicator | | | VS | Variable Speed |
| SY | Speed | Calculation | | | VB | Vacuum Breaker |
| | | | | | Vj | Velocity of Jet |
| ZT | Position | Transmitter | | | Vw | Velocity of Wire |
| ZI | Position | Indicator | | | Vj/Vw | Jet to Wire Velocity Ratio |

FIG. 4

CONTROLLING THE SLICE FLOW OF A SLURRY THROUGH A HEADBOX

CROSS-REFERENCES TO RELATED APPLICATIONS

This application claims the benefit of U.S. Provisional Application No. 63/007,693, filed Apr. 9, 2020, the content of which is hereby incorporated herein by reference in its entirety.

BACKGROUND

Unless otherwise indicated herein, the materials described in this section are not prior art to the claims in this application and are not admitted to be prior art by inclusion in this section.

A multi-ply headbox separately delivers slurries having different fiber consistencies until combined into one continuous slurry in the final product. Flexible membranes in the nozzle area of the headbox are used to smooth out pressure variations in the slurry flows and keep the slurries separate. The pressure and flow of the slurries in the nozzle area should be kept stable to provide consistent paper quality and keep the flexible membranes tips from experiencing excessive stress. Typically, the pressure and flow in the nozzle are provided by multiple separate pumps from as many tanks holding slurries having different consistencies. The pressure control of the pumps can determine the stability of the pressure and flow in the nozzle. The pressure in the nozzle and the size of nozzle gap determine the flow and the speed of the slurry in the process. The relative speed and flow of the slurry determine to a large degree the quality of the final product.

One traditional method of controlling the pressure and the flow in the headbox nozzle is by measuring the pressure in the nozzle area and controlling the fan pump speed to determine the speed of the slurry and adjusting the gap to vary the flow. The flow is calculated based on speed of the slurry, the size of the gap, and the gap contraction coefficient. Another method is to control the flow of the slurry by varying the pump speed based on calculating the slurry flow from flow measurements in the feed and return lines and controlling the pressure (slurry speed) by changing the nozzle outlet gap. Both of these methods rely on the indirect measurement of nozzle flow using multiple flow meters or estimated gap contraction coefficient.

In the traditional methods pressures and flows cannot be determined when the process is started since the nozzle is empty. The flow is introduced into the nozzle area without any control of the pressure. The speed (e.g., revolutions per minute (rpm)) of the fan pumps is set to control the flow of slurry until pressure is sensed in the nozzle. This method presents a variability in the amount of pressure that is achieved for a given rpm as the net positive suction head and the pressure drop across components disposed between the fan pumps and the headbox is not constant. As a result, random stresses may be placed on the flexible membranes during the initial filling of the nozzle. Since control of the pressure differential in the nozzle is needed to achieve desired paper quality, constant correction of the ply fan pumps to minimize the pressure differential is performed resulting in variations in product quality.

SUMMARY

Systems and methods for controlling the slice flow of a slurry through a headbox for a paper making machine used in the pulp and paper industry are provided.

According to various aspects there is provided a method for controlling a slice flow of a slurry having two or more component slurries through a headbox for a paper making machine. In some aspects, the method may include: inputting a wire speed of the paper making machine or a ratio of a jet velocity to the wire speed of the paper making machine; determining a jet velocity setpoint based on the wire speed of the paper making machine or the ratio of the jet velocity to the wire speed of the paper making machine; determining a header pressure setpoint for two or more headers to generate the jet velocity determined by the jet velocity setpoint, each header providing one of the two or more component slurries to the headbox; and controlling the slice flow by: generating a first speed command to a first slurry pump to generate a header pressure determined by the header pressure setpoint in a first header; and generating a second speed command to a second slurry pump to generate the header pressure determined by the header pressure setpoint in a second header.

According to various aspects there is provided a control system for controlling a slice flow of a slurry having two or more component slurries through a headbox for a paper making machine. In some aspects, the control system may include: an operator control module configured to receive input instructions; pressure transmitters configured to transmit measured slurry pressures; flow transmitters configured to transmit measured slurry flow rates; pressure controllers configured to control slurry pressures; speed controllers configured to control speeds of slurry pumps; and a processor in communication with the operator control module, the pressure controllers and speed controllers.

The processor may be configured to receive a wire speed of the paper making machine or a ratio of a jet velocity to the wire speed of the paper making machine from the operator control module; determine a jet velocity setpoint based on the wire speed of the paper making machine or the ratio of the jet velocity to the wire speed of the paper making machine; determine a header pressure setpoint for two or more headers to generate the jet velocity determined by the jet velocity setpoint, each header providing one of the two or more component slurries to the headbox; and control the slice flow by: causing a first pressure controller to generate a first speed command to a first speed controller for a first slurry pump to generate a header pressure determined by the header pressure setpoint in a first header; and causing a second pressure controller to generate a second speed command to a second speed controller for a second slurry pump to generate the header pressure determined by the header pressure setpoint in a second header.

According to various aspects there is provided a non-transitory computer readable medium. In some aspects, non-transitory computer readable medium may include instructions for making one or more processors execute a method for controlling a slice flow of a slurry having two or more component slurries through a headbox for a paper making machine, including: receiving a wire speed of the paper making machine or a ratio of a jet velocity to the wire speed of the paper making machine from an operator control module; determining a jet velocity setpoint based on the wire speed of the paper making machine or the ratio of the jet velocity to the wire speed of the paper making machine; determining a header pressure setpoint for two or more headers to generate the jet velocity determined by the jet velocity setpoint, each header providing one of the two or more component slurries to the headbox; and controlling the slice flow by: causing a first pressure controller to generate a first speed command to a first speed controller for a first slurry pump to generate a header pressure determined by the header pressure setpoint in a first header; and causing a second pressure controller to generate a second speed command to a second speed controller for a second slurry pump to generate the header pressure determined by the header pressure setpoint in a second header.

BRIEF DESCRIPTION OF THE DRAWINGS

Aspects and features of the various embodiments will be more apparent by describing examples with reference to the accompanying drawings, in which:

FIG. 4 is a table corresponding to the measurement and control elements illustrated in the process diagram of FIG. 2 according to some aspects of the present disclosure;

DETAILED DESCRIPTION

Figure 1:
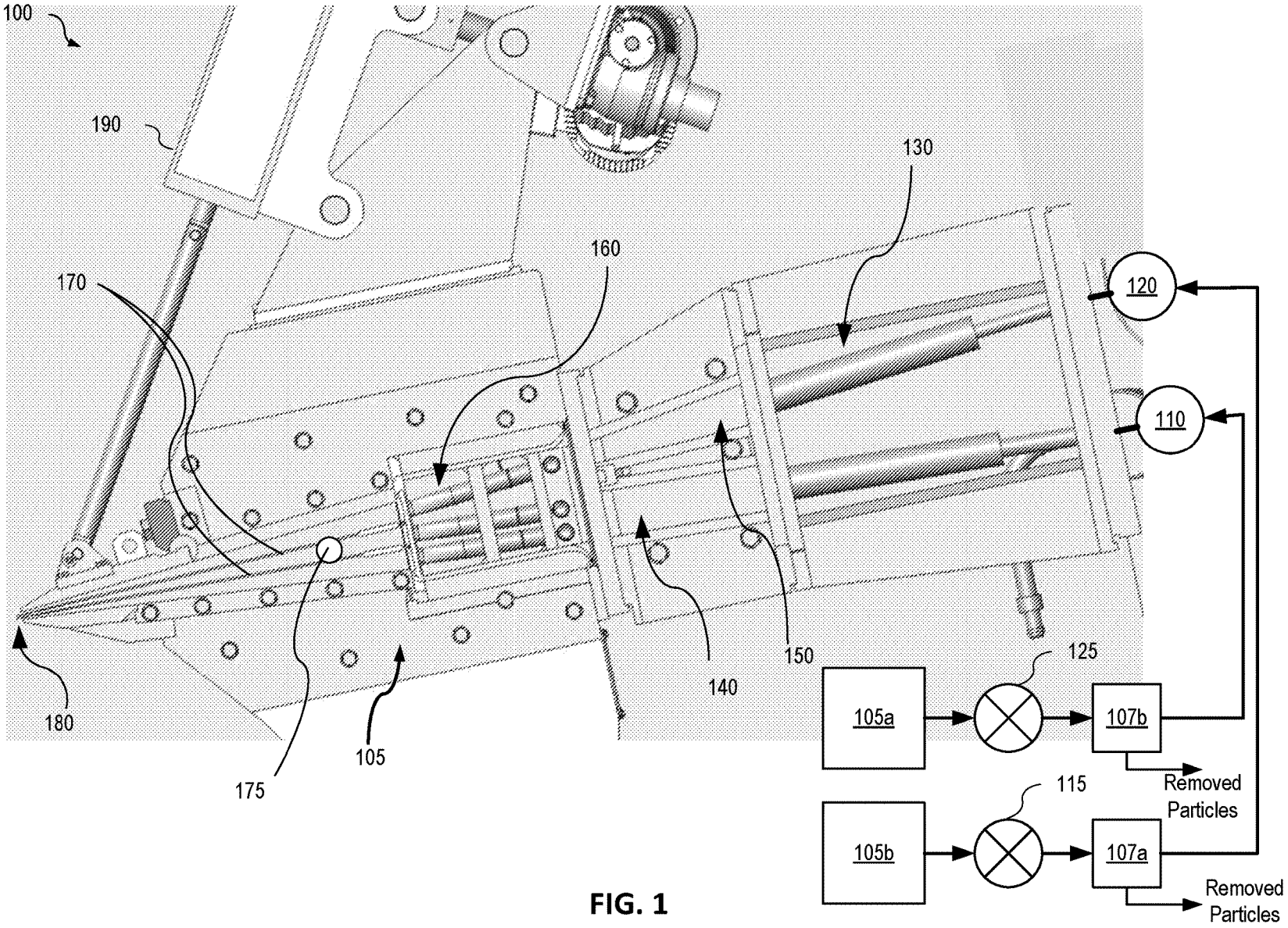
FIG. 1 is diagram illustrating a multi-ply headbox for a paper making machine according to some aspects of the present disclosure.

While certain embodiments are described, these embodiments are presented by way of example only, and are not intended to limit the scope of protection. The apparatuses, methods, and systems described herein may be embodied in a variety of other forms. Furthermore, various omissions, substitutions, and changes in the form of the example methods and systems described herein may be made without departing from the scope of protection.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

The headbox of a paper making machine is a pressurized device that delivers a uniform pulp slurry through a slice of the headbox onto the wire of the paper making machine at approximately the same speed as that of the wire. A multi-ply headbox combines different types of fiber slurries into one continuous slurry that allows the fiber slurries to remain separate until combined at the slice to provide the final product. Flexible membranes in the nozzle area of the headbox may be used to minimize pressure variations in the separate slurries. For a multi-ply application, the pressure differential in the nozzle between the slurries for the different plys should be controlled to minimize stress induced on the flexible membranes. The pressures in the nozzle for the separate slurries may be controlled by measuring the slurry flows, for example, using flow meters, and controlling the speeds of separate pumps for each slurry. During the fill sequence, however, the flow of the slurries is too low to be directly measured by the inline flow meters.

FIG. 1 is diagram illustrating a multi-ply headbox 100 for a paper making machine according to some aspects of the present disclosure. Referring to FIG. 1, the multi-ply headbox 100 may include a first cross machine header 110, a second cross machine header 120, a first pump 115, a second pump 125, distribution manifold tubes 130, a first stilling chamber 140, a second stilling chamber 150, turbulence generator tubes 160, and a nozzle assembly 105. The nozzle assembly 105 may include flexible membranes 170, a nozzle pressure transmitter 175, and a nozzle gap, or slice, 180. The slice 180 may be adjusted via an adjusting mechanism 190.

A first slurry tank 105*a* may contain a slurry having a first consistency, for example, a slurry designed to provide strength to a multi-ply paper product. The second slurry tank 105*b* may contain a slurry having a second consistency, for example, a slurry designed to enhance the appearance of the multi-ply paper product. The first and second pumps 115, 125, may control the pressure and/or flow of the slurries into the cross machine headers 110, 120 from the first and second slurry tanks 105*a*, 105*b*, respectively, to the distribution manifold tubes 130. Screens 107*a*, 107*b* may be disposed between the first and second pumps 115, 125 and the first and second cross machine headers 110, 120 and may remove particles of each of the slurries that can affect product quality. Particles removed from the slurries by the screens 107*a*, 107*b* may be sent to separate cleaning processes. The particle removal process may a direct a portion of the slurry flow away from the process.

The first stilling chamber 140 may receive the slurry from the first slurry tank 105*a* via the distribution manifold tubes 130. The second stilling chamber 150 may receive the slurry from the second slurry tank 105*b* via the distribution manifold tubes 130. The first and second stilling chambers 140, 150 may provide flow leveling (e.g., smoothing of variations in the flow) for the slurries while maintaining separation of the slurries. From the first and second stilling chambers 140, 150, the slurries may flow into the nozzle assembly 105.

The slurries enter the turbulence generator tubes 160. The turbulence generator tubes 160 may cause turbulence to separate clumped fibers in the slurries. The slurries flow out of the turbulence generator tubes 160 into the flexible membranes 170 that are part of the nozzle assembly. The flexible membranes may smooth out pressure variations in the slurry flows. The nozzle pressure transmitter 175 may be a high resolution pressure transmitter and may provide pressure measurements of the slurries flowing through the flexible membranes 170. At the end of the nozzle assembly 105, the separate slurries are combined into a multi-ply slurry, in this example two plies, at the slice 180 as they exit the flexible membranes 170. The speed of the multi-ply slurry exiting the slice 180 should be in a ratio to the speed of the wire (not shown) of the paper machine according to the quality desired of the product.

Figure 2:
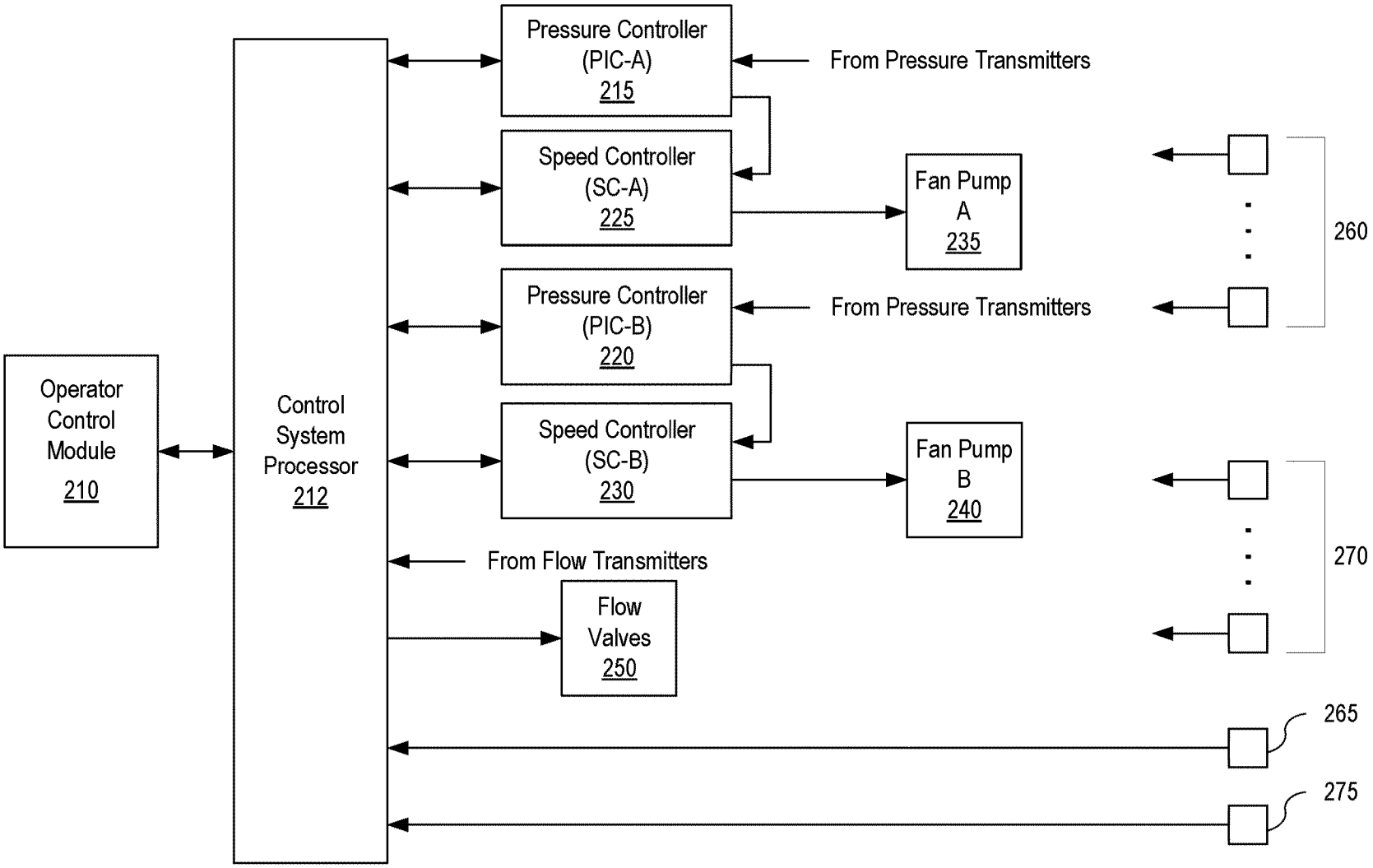
FIG. 2 is a simplified block diagram of a control system for a multi-ply headbox for a paper making machine according to some aspects of the present disclosure.

FIG. 2 is a simplified block diagram of a control system 200 for a multi-ply headbox for a paper making machine according to some aspects of the present disclosure. The control system 200 may include an operator control module 210, two or more pressure controllers 215, 220, two or more speed controllers 225, 230, two or more pumps 235, 240, flow valves 250, a plurality of pressure transmitters 260, a slice position transmitter 265, a plurality of flow transmitters 270, and nozzle pressure transmitters 275.

The operator control module 210 may include a control system processor 212. The control system processor 212 may be, for example, a general purpose processor, a digital signal processor (DSP), an application specific integrated circuit (ASIC), a field programmable gate array (FPGA) or other programmable logic device. The operator control module 210 may include one of more display devices (not shown) configured to display various pressure values, flow values, setpoint values, and/or other process values. The operator control module 210 may include one of more input devices (not shown) configured to enable input of operator-adjustable process parameter values.

The pressure controllers 215, 220 may be, for example, but not limited to, programmable logic controllers or other programmable devices configurable to maintain a pressure according to a setpoint value. Separate control loops may be provided for each slurry flowing into the multi-ply headbox. A separate pressure controller may be provided for each control loop. In some implementations, the pressure controllers 215, 220 may be implemented by the control system processor 212.

The speed controllers 225, 230 may be, for example, but not limited to, programmable logic controllers or other programmable devices configurable to maintain a fan speed according to a setpoint. A separate speed controller may be provided for each fan pump. In some implementations, the speed controllers 225, 230 may be implemented by the control system processor 212.

The pressure transmitters 260 may be high resolution pressure transmitters. Inlet pressure transmitters may be disposed on the cross machine headers (e.g., the cross machine headers 110, 120) or on other inlet piping to the headbox. The inlet pressure transmitters can allow for a controlled introduction of all slurry flows into the nozzle assembly such that minimal differential pressure is exerted on the flexible membranes during startup and shutdown of the process, as well as during normal operation. The nozzle pressure transmitters 275 may be disposed on the nozzle assembly of the headbox. The high resolution inlet and nozzle pressure transmitters can enable stable and repeatable flow calculation that are independent of the inherent variability in the exit geometry of the nozzle orifice. Further, effects of slurry conductivity and density on the pressure indications may be minimized.

Measurement signals provided from inlet pressure transmitters disposed on the inlet piping, referred to as the header, may be used to control fan pump pressure in each control loop. The measurement signals can provide an indication of the differential pressure between the headers. The inlet pressure transmitters, the slice transmitter and the nozzle pressure may also provide a feed-forward value to the pressure control of the fan pumps to insure proper slurry flow ratio of the nozzle pressure control loop. The control of the slurry delivered from the fan pumps by use of the inlet pressure transmitters can provide consistent starting and stopping functions independent of process variations.

Measurement signals provided from a nozzle pressure transmitter disposed on the nozzle assembly in combination with the measurement signals provided from inlet pressure transmitters may be used to calculate the flow of the slurry exiting the slice. The pressure differential between the pressure measured by the inlet pressure transmitters and the pressure measured by the nozzle pressure transmitters can determine the pressure drop across the turbulence generator and can enable calculation the flow of the slurry out of the nozzle. Slurry velocity (e.g., jet velocity) may also be determined from the pressure measurements. The slurry flow and the slurry velocity can determine the quality of the final product produced by the process.

In some cases, the differential pressure between the headers HA and HB (e.g., as measured by the pressure calculation block PDY-A_B) may exceed a specified threshold based on a particular process. In the event that the pressure deviation (PDY-A-B) exceeds the threshold, an alarm may be indicated and an operator may take action to prevent degradation of product quality. In some cases, the process may be shutdown to prevent damage to the equipment.

The pumps 235, 240 may be fan pumps or other types of pumps, for example, but not limited to, centrifugal pumps. The respective speeds of the pumps 235, 240 may depend on the relative flow rates of the respective pumps, the type of piping that connects the slurry tanks to the pumps, and the type of piping that connects the pumps to the screens (e.g., filters connected between the pumps and the header), and finally to the inlet header.

Figure 3:
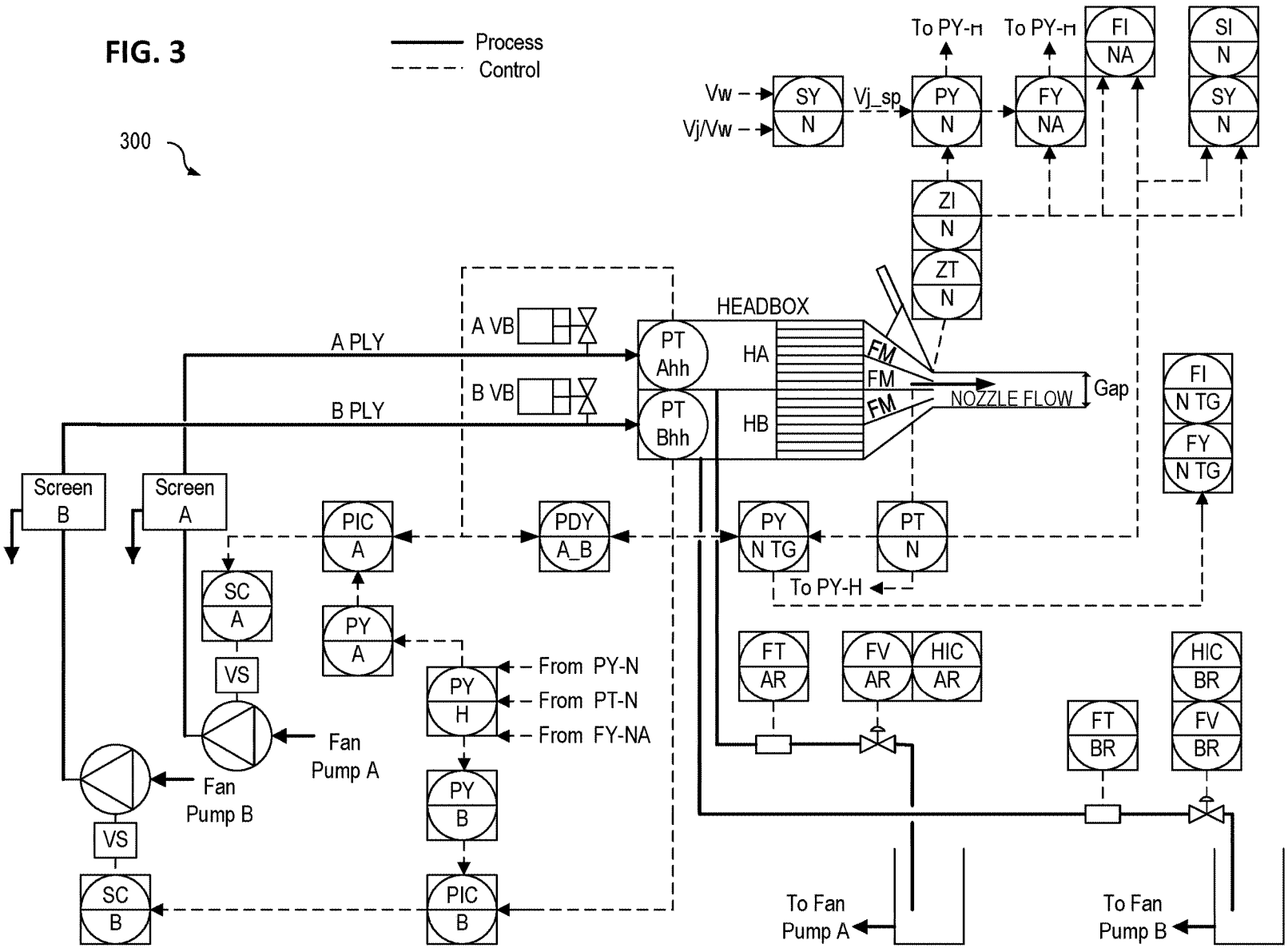
FIG. 3 is a process diagram illustrating an example of control process for a multi-ply headbox for a paper making machine according to various aspects of the present disclosure.

FIG. 3 is a process diagram 300 illustrating an example of control process for a multi-ply headbox for a paper making machine according to various aspects of the present disclosure. FIG. 4 is a table 400 corresponding to the measurement and control elements illustrated in the process diagram of FIG. 3 according to some aspects of the present disclosure. The pressure and speed controllers as well as the pressure, flow, and speed calculation blocks illustrated in FIG. 3 may be implemented by the control system processor (e.g., the control system processor 212) or by other programmable devices.

Referring to FIG. 3, a wire speed value (e.g., a wire speed '$V_w$' of the paper machine) or a value for a ratio of a jet velocity value to wire speed ($V_j/V_w$) may be input to a speed calculation block SY-N. The speed calculation block SY-N may output a desired jet velocity setpoint value $V_{j_sp}$. The jet velocity setpoint value $V_{j_sp}$ and a slice opening value from the position indicator ZI-N may be input to a nozzle assembly pressure calculation block PY-N. The pressure calculation block PY-N may output a desired nozzle pressure value (e.g., nozzle pressure setpoint) $P_{n_sp}$ to a header pressure calculation block PY-H and to a flow calculation block FY-NA, for example, according to equation A:

$$P_{n_sp} = \frac{V_{j_sp}^2}{2 \cdot g} + (z_N - z_2) \tag{A}$$

$P_{n_sp}$=nozzle pressure setpoint $V_{j_sp}$=velocity setpoint of jet exiting the slice opening g=gravitational constant $(z_N-z_2)$=elevation difference between nozzle pressure transmitter position $z_N$ and the position where the jet contacts the wire $z_2$ The flow calculation block FY-NA may output a calculated value for a desired slurry flow rate value in the nozzle assembly (e.g., nozzle flow rate setpoint) $Q_{SP}$, for example, according to equation B:

$$Q_{SP}=V_{j_sp} \cdot W \cdot (SO+d \cdot C_c) \tag{B}$$

$Q_{SP}$=nozzle flow rate setpoint w=width of the slice opening (e.g., pond width)

$C_c$=contraction coefficient

SO=slice opening d=incremental slice opening depending on headbox pressure $V_j$=velocity of jet exiting the slice opening The header pressure calculation block PY-H may also receive a measured nozzle pressure value from the nozzle pressure transmitter PT-N. Based on the inputs, the header pressure calculation block PY-H may output pressure values to a pressure calculation block PY-A for a first control loop (control loop A) and to a pressure calculation block PY-B for a second control loop (control loop B). The pressure calculation block PY-A may output a setpoint pressure value to a pressure controller PIC-A for control loop A. The pressure controller PIC-A may be, for example, but not limited to, a proportional-integral-differential (PID) controller. The pressure controller may be implemented by the control system processor (e.g., the control system processor 212).

The pressure controller PIC-A may also receive a header pressure feedback value (e.g., a measured pressure value) for the slurry A flow from the header pressure transmitter PT-Ahh. The proportional-integral control capabilities of the controller may calculate the error between the setpoint pressure value received from the pressure calculation block PY-A and the feedback value (or measured value) received from the header pressure transmitter PT-Ahh. The pressure controller PIC-A may apply proportional and integral gains to the error to generate and output the correction needed to change the controlled value in the process. For example, the pressure controller PIC-A may output a correction value for the speed of the fan pump A to maintain a header pressure setpoint, for example, according to equation C:

$$P_{Ahh_sp} = P_{n_sp} + \left(\frac{Q_{SP}^2}{Cv_{tg}^2} - H_i\right) \tag{C}$$

$P_{Ahh_sp}$=header pressure setpoint $P_{n_sp}$=nozzle pressure setpoint $Q_{SP}$=nozzle flow rate setpoint $C_{Vtg}$=turbulence generator flow coefficient $H_i$=elevation difference between the position of the nozzle pressure transmitter PT-N and the position of the header pressure transmitter PT-$P_{Ahh}$ Similar header pressure setpoint calculations may be performed, for example, for the header pressure setpoint $P_{Bhh_sp}$, headers having different header geometries using modifications to equation C to account for the differences in geometry.

Based on the setpoint pressure input from the pressure calculation block PY-A and the measured pressure input from the header pressure transmitter PT-A, the pressure controller PIC-A may output a value to a speed controller SC-A to control the fan pump speed for control loop A, thereby controlling the pressure of the slurry flowing to the header HA for the first slurry.

Similarly, pressure calculation block PY-B may output a pressure value to a pressure controller PIC-B for control loop B. The pressure controller PIC-B may be, for example, but not limited to, a proportional-integral-differential (PID) controller. The pressure controller may be implemented by the control system processor (e.g., the control system processor 212).

The pressure controller PIC-B may also receive a header pressure feedback value from the header pressure transmitter PT-B for the slurry B flow from the header pressure transmitter PT-Bhh. The proportional-integral control capabilities of the controller may calculate the error between the setpoint pressure value received from the pressure calculation block PY-B and the feedback value (or measured value) received from the header pressure transmitter PT-Bhh. The pressure controller PIC-B may apply proportional and integral gains to the error to generate and output the correction needed to change the controlled value in the process. For example, the pressure controller PIC-B may output a correction value for the speed of the fan pump B.

Based on the setpoint pressure input from the pressure calculation block PY-B and the measured pressure input from the header pressure transmitter PT-B, the pressure controller PIC-B may output a value to a speed controller SC-B to control the fan pump speed for control loop B, thereby controlling the pressure of the slurry flowing to the header HB for the first slurry.

The slice flow rate as a function of jet velocity and slice opening may be calculated, for example, according to equation D:

$$Q=w \cdot C_c \cdot (SO+d) \cdot V_j \tag{D}$$

where w=width of the slice opening (e.g., pond width)

$C_c$=contraction coefficient

SO=slice opening d=incremental slice opening depending on headbox pressure $V_j$=velocity of jet exiting the slice opening The slice flow as a function of turbulence generator head loss may be calculated, for example, according to equation E:

$$q_n = Cv_{tg}\left[\frac{(P_{Ahh} - P_n)}{k} - H_i\right]^{1/2} \quad \text{(E)}$$

where $q_n$=slice flow $P_{Ahh}$=pressure in headbox header $P_n$=pressure in nozzle (total head)

$H_i$=elevation difference between the position of the nozzle pressure transmitter PT-N and the position of the header pressure transmitter PT-$P_{Ahh}$ $C_{Vtg}$=turbulence generator flow coefficient k=unit conversion constant The slice flow as a function of the flow meter measurements may be calculated, for example, according to equation F:

$$q_n = q_{nAfeed} - q_{nAreject} - q_{nAreturn} + q_{nBfeed} - q_{nBreject} - q_{nBreturn} \quad \text{(F)}$$

where qnAfeed=feed flow of ply A qnAreject=reject flow of ply A qnAreturn=return flow of ply A qnBfeed=feed flow of ply B qnAreject=reject flow of ply B qnAreturn=return flow of ply B As can be seen from equation C, any slurry not directly injected into the turbulence generator will not affect the resultant slice flow. Additional terms may be added to equation F to account for additional flows for additional plies.

The jet velocity may be calculated, for example, according to equation G:

$$V_j = [2 \cdot g \cdot (P_n + (z_N - z_2))]^{1/2} \quad \text{(G)}$$

where $V_j$=velocity of jet exiting the slice opening g=gravitational constant $P_n$=pressure in nozzle (total head)

$(z_N - z_2)$=elevation difference between nozzle pressure transmitter position $z_N$ and the position where the jet contacts the wire $z_2$ The target jet velocity ($V_j$) may be determined by the jet-to-wire ratio ($V_j/V_w$). For example, if $V_j/V_w$ is 1.1, then the jet velocity target will be 1.1 times the wire velocity. Calculation of the jet velocity may depend on the magnitude of the slice opening and physical dimensions of the slice opening.

To allow continuous control of the jet velocity from system start until system shutdown, the control system may calculate the target slice flow based on a current slice opening and may combine the calculated slice flow with calculated target nozzle pressure to determine the setpoint for the inlet header pressure controllers. The inlet header pressure may be calculated as a function of nozzle flow rate ($q_n$) and nozzle pressure ($P_n$).

Figure 5:
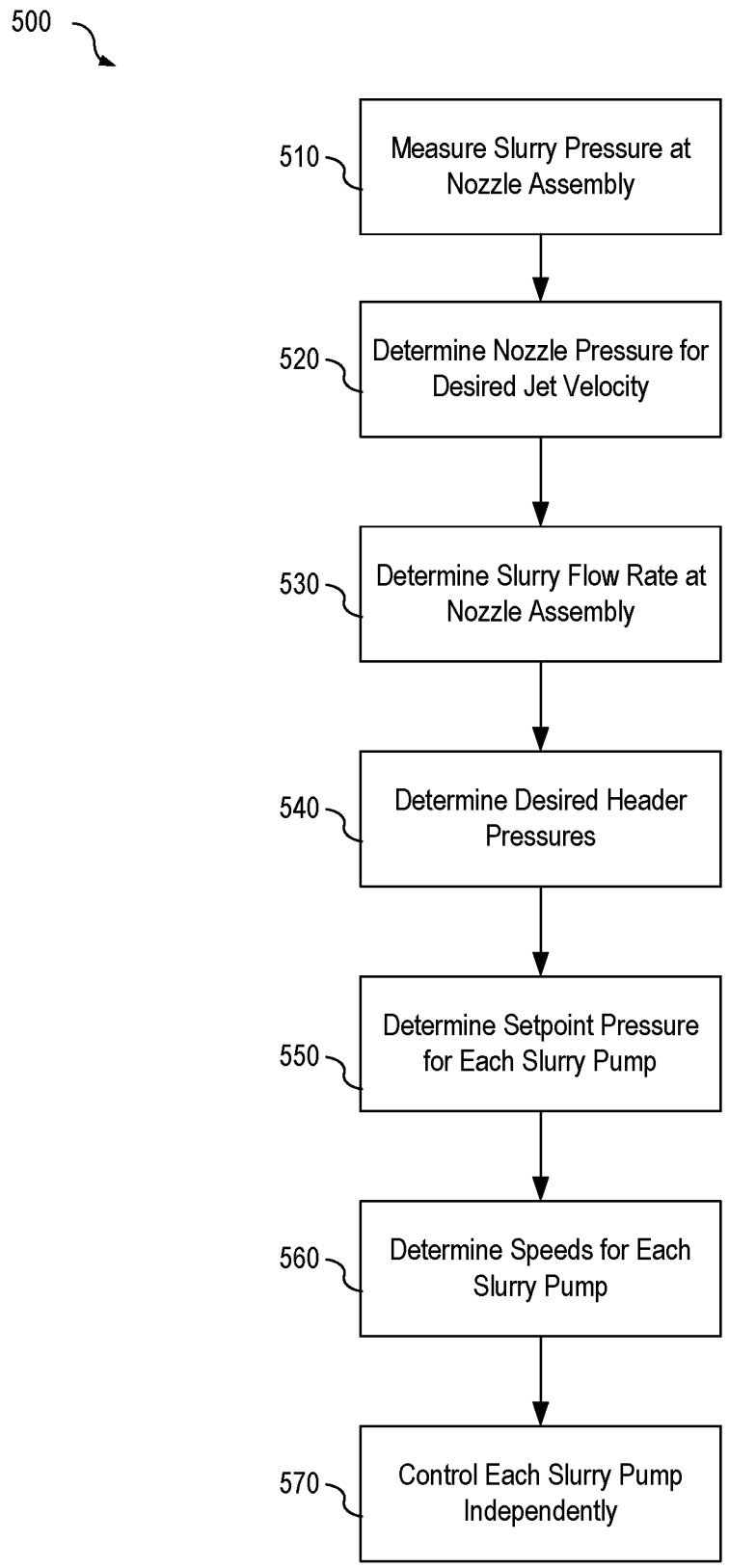
FIG. 5 is a flowchart illustrating an example of a method for controlling the slice flow of a slurry through a headbox for a paper making machine according to aspects of the present disclosure.

FIG. 5 is a flowchart illustrating an example of a method 500 for controlling the slice flow of a slurry through a headbox for a paper making machine according to aspects of the present disclosure. Referring to FIG. 5 and FIG. 3, at block 510, the slurry pressure at the nozzle assembly may be measured. The slurry pressure at the nozzle assembly may be generated by pressures from two or more different component slurries. For example, a pressure transmitter (e.g., the nozzle assembly pressure transmitter PT-N) may measure the pressure of the slurry flowing through the nozzle assembly.

At block 520, the slurry pressure at the nozzle assembly for a desired jet velocity may be determined. A jet velocity setpoint may be input to a nozzle assembly pressure calculation block (e.g., the nozzle assembly pressure calculation block PY-N). The nozzle assembly pressure calculation block may calculate the desired slurry pressure at the nozzle assembly for the desired jet velocity based on the jet velocity setpoint and the slice position determined by a slice position transmitter (e.g., the position transmitter ZT).

At block 530, the slurry flow rate at the nozzle assembly may be determined. The slurry flow rate at the nozzle assembly may be a combined flow rate of two or more different component slurries. A flow calculation block (e.g., the flow calculation block FY-NA) may calculate the slurry flow rate at the nozzle assembly based on the slice position determined by the slice position transmitter (e.g., the position transmitter ZT) and the desired slurry pressure at the nozzle assembly.

At block 540, the desired header pressures may be determined. A header pressure calculation block (e.g., the header pressure calculation block PY-H) may determine the desired header pressures to achieve the desired pressure and flow rate for the slurry at the nozzle assembly. The header pressure calculation block may determine the desired header pressures based on nozzle assembly pressure input from the nozzle assembly pressure calculation block, measured slurry pressure at the nozzle assembly from the nozzle assembly pressure transmitter, and the slurry flow rate calculated by the flow calculation block.

At block 550, setpoint pressures for each slurry pump may be determined. A first pressure calculation block (e.g., the pressure calculation block PY-A) for a first control loop may calculate a pressure setpoint for a first slurry pressure based on a pressure input from the header pressure calculation block. Similarly, a second pressure calculation block (e.g., the pressure calculation block PY-B) for a second control loop may calculate a pressure setpoint for a second slurry pressure based on the pressure input from the header pressure calculation block.

At block 560, speeds for each slurry pump may be determined. A first pressure controller (e.g., the pressure controller PIC-A) may calculate a desired speed for a first slurry pump (e.g., the fan pump A) for the first slurry based on the pressure setpoint input from the first pressure calculation block and a measured header pressure input from a first header pressure transmitter (e.g., the header pressure transmitter PT-Ahh) for the first slurry. Similarly, a second pressure controller (e.g., the pressure controller PIC-B) may calculate a desired speed for a second slurry pump (e.g., the fan pump B) for the second slurry based on the pressure setpoint input from the second pressure calculation block and a measured header pressure input from a second header pressure transmitter (e.g., the header pressure transmitter PT-Bhh) for the second slurry.

At block 570, each slurry pump may be independently controlled. The first pressure controller may output the desired pump speed for the first slurry pump to the first speed controller (e.g., the speed controller SC-A) for the first control loop. The first speed controller may control the speed of the first slurry pump to achieve the desired header pressure for the first slurry. Similarly, the second pressure controller may output the desired pump speed for the second slurry pump to the second speed controller (e.g., the speed controller SC-B) for the second control loop. The second speed controller may control the speed of the second slurry pump to achieve the desired header pressure for the second slurry. Thus, the header pressure for each slurry is independently controlled by the separate control loops.

Independent control of the header pressures of the first and second slurries can provide control of the of the slurry flow rate through the nozzle assembly while maintaining a slurry ratio and achieving the desired jet velocity at the headbox slice.

The specific operations illustrated in FIG. 5 provide a particular method for controlling the slice flow of a slurry through a headbox for a paper making machine according to an embodiment of the present disclosure. Other sequences of operations may also be performed according to alternative embodiments. For example, alternative embodiments of the present disclosure may perform the operations outlined above in a different order. Moreover, the individual operations illustrated in FIG. 5 may include multiple sub-operations that may be performed in various sequences as appropriate to the individual operation. Furthermore, additional operations may be added or removed depending on the particular applications.

While the example of the method 500 has been explained using two slurry components for ease of explanation, more than two slurry components may be used without departing from the scope of the present disclosure.

The method 500, may be embodied on a non-transitory computer readable medium known to those of skill in the art, having stored therein a program including computer executable instructions for making a processor, computer, or other programmable device execute the operations of the methods.

Figure 6:
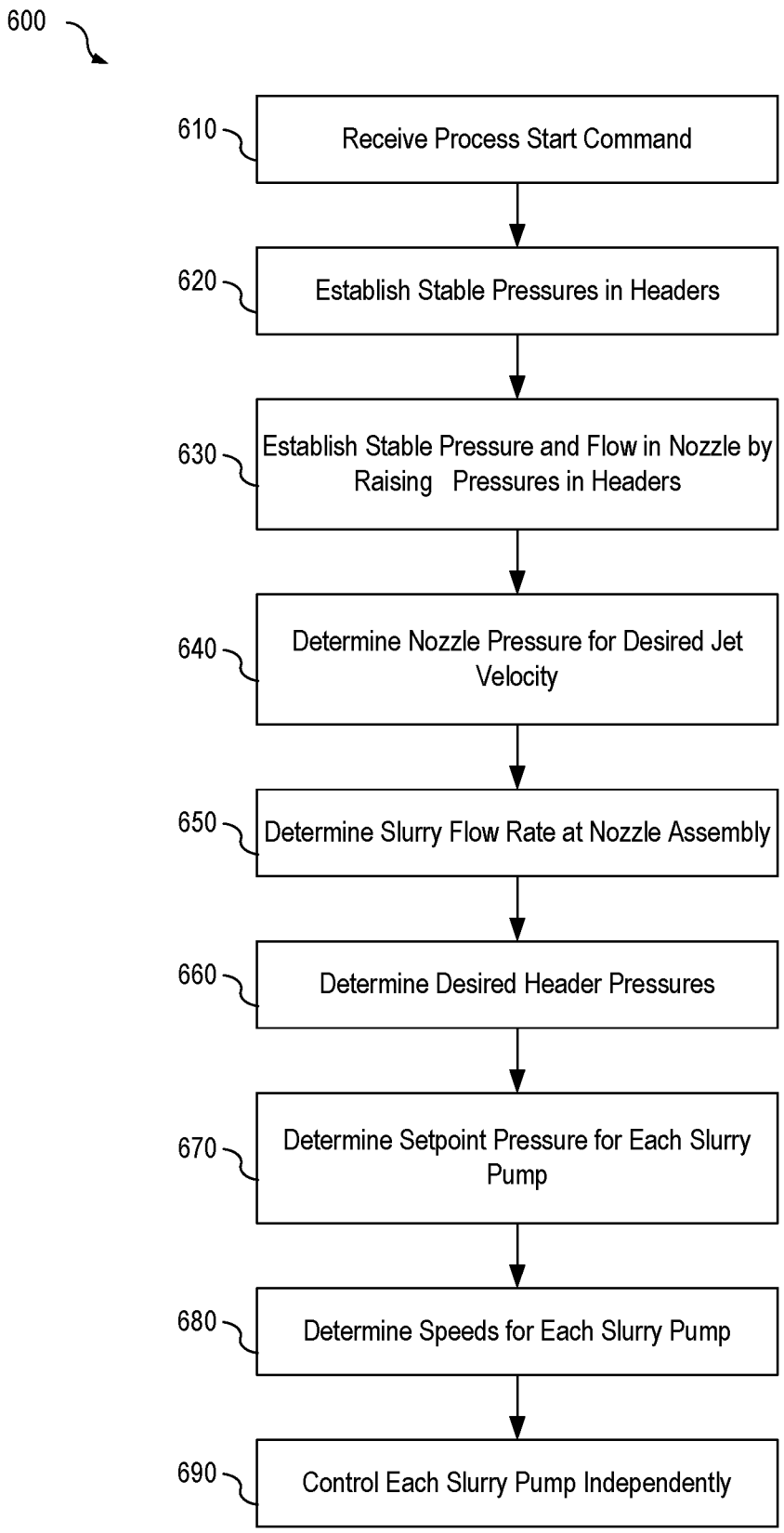
FIG. 6 is a flowchart illustrating an example of a method for controlling the slice flow of a slurry through a headbox for a paper making machine during startup operation according to aspects of the present disclosure.

FIG. 6 is a flowchart illustrating an example of a method 600 for controlling the slice flow of a slurry through a headbox for a paper making machine during startup operation according to aspects of the present disclosure. Referring to FIG. 5 and FIG. 3, at block 610, a process start command may be received. For example, a start command may be input via the operator control module.

At block 620, stable pressures in the headers may be established. For example, after receiving the start command, the control system may cause pressure in the headers (e.g., the cross machine headers 110, 120) to be set to a specified initial pressure. The specified initial pressure may be lower than the operational pressure for the process. The control system may provide individual control of the speeds of the fan pumps for each header to individually control the pressure in each header. Upon achieving the specified initial pressure, the control system may maintain the pressure for a predetermined period of time.

At block 630, stable flow and pressure in the nozzle may be established. For example, at the end of the predetermined period of time for maintaining the initial pressure, the control system may slowly raise the pressures in the headers to establish a stable specified pressure and specified flow in the nozzle. The pressures in the headers that establish the specified pressure and specified flow in the nozzle may be higher than the initial pressure. The control system may provide individual control of the speeds of the fan pumps for each header to individually control the pressure in each header. The control system may also control the slice opening to establish the specified flow in the nozzle.

At block 640, the slurry pressure at the nozzle assembly for a desired jet velocity may be determined. A jet velocity setpoint may be input to a nozzle assembly pressure calculation block (e.g., the nozzle assembly pressure calculation block PY-N). The nozzle assembly pressure calculation block may calculate the desired slurry pressure at the nozzle assembly for the desired jet velocity based on the jet velocity setpoint and the slice position determined by a slice position transmitter (e.g., the position transmitter ZT).

At block 650, the slurry flow rate at the nozzle assembly may be determined. The slurry flow rate at the nozzle assembly may be a combined flow rate of two or more different component slurries. A flow calculation block (e.g., the flow calculation block FY-NA) may calculate the slurry flow rate at the nozzle assembly based on the slice position determined by the slice position transmitter (e.g., the position transmitter ZT) and the desired slurry pressure at the nozzle assembly.

At block 660, the desired header pressures may be determined. A header pressure calculation block (e.g., the header pressure calculation block PY-H) may determine the desired header pressures to achieve the desired pressure and flow rate for the slurry at the nozzle assembly. The header pressure calculation block may determine the desired header pressures based on nozzle assembly pressure input from the nozzle assembly pressure calculation block, measured slurry pressure at the nozzle assembly from the nozzle assembly pressure transmitter, and the slurry flow rate calculated by the flow calculation block.

At block 670, setpoint pressures for each slurry pump may be determined. A first pressure calculation block (e.g., the pressure calculation block PY-A) for a first control loop may calculate a pressure setpoint for a first slurry pressure based on a pressure input from the header pressure calculation block. Similarly, a second pressure calculation block (e.g., the pressure calculation block PY-B) for a second control loop may calculate a pressure setpoint for a second slurry pressure based on the pressure input from the header pressure calculation block.

At block 680, speeds for each slurry pump may be determined. A first pressure controller (e.g., the pressure controller PIC-A) may calculate a desired speed for a first slurry pump (e.g., the fan pump A) for the first slurry based on the pressure setpoint input from the first pressure calculation block and a measured header pressure input from a first header pressure transmitter (e.g., the header pressure transmitter PT-Ahh) for the first slurry. Similarly, a second pressure controller (e.g., the pressure controller PIC-B) may calculate a desired speed for a second slurry pump (e.g., the fan pump B) for the second slurry based on the pressure setpoint input from the second pressure calculation block and a measured header pressure input from a second header pressure transmitter (e.g., the header pressure transmitter PT-Bhh) for the second slurry.

At block 690, each slurry pump may be independently controlled. The first pressure controller may output the desired pump speed for the first slurry pump to the first speed controller (e.g., the speed controller SC-A) for the first control loop. The first speed controller may control the speed of the first slurry pump to achieve the desired header pressure for the first slurry. Similarly, the second pressure controller may output the desired pump speed for the second slurry pump to the second speed controller (e.g., the speed controller SC-B) for the second control loop. The second speed controller may control the speed of the second slurry pump to achieve the desired header pressure for the second slurry. Thus, the header pressure for each slurry is independently controlled by the separate control loops.

Independent control of the header pressures of the first and second slurries can provide control of the of the slurry flow rate through the nozzle assembly while maintaining a slurry ratio and achieving the desired jet velocity at the headbox slice. Further, the nozzle assembly may be filled with the slurries while the header pressure for each slurry is controlled.

The specific operations illustrated in FIG. 6 provide a particular method for controlling the slice flow of a slurry through a headbox for a paper making machine during startup operation according to an embodiment of the present disclosure. Other sequences of operations may also be performed according to alternative embodiments. For example, alternative embodiments of the present disclosure may perform the operations outlined above in a different order. Moreover, the individual operations illustrated in FIG. 6 may include multiple sub-operations that may be performed in various sequences as appropriate to the individual operation. Furthermore, additional operations may be added or removed depending on the particular applications.

While the example of the method 600 has been explained using two slurry components for ease of explanation, more than two slurry components may be used without departing from the scope of the present disclosure.

The method 600, may be embodied on a non-transitory computer readable medium known to those of skill in the art, having stored therein a program including computer executable instructions for making a processor, computer, or other programmable device execute the operations of the methods.

Figure 7:
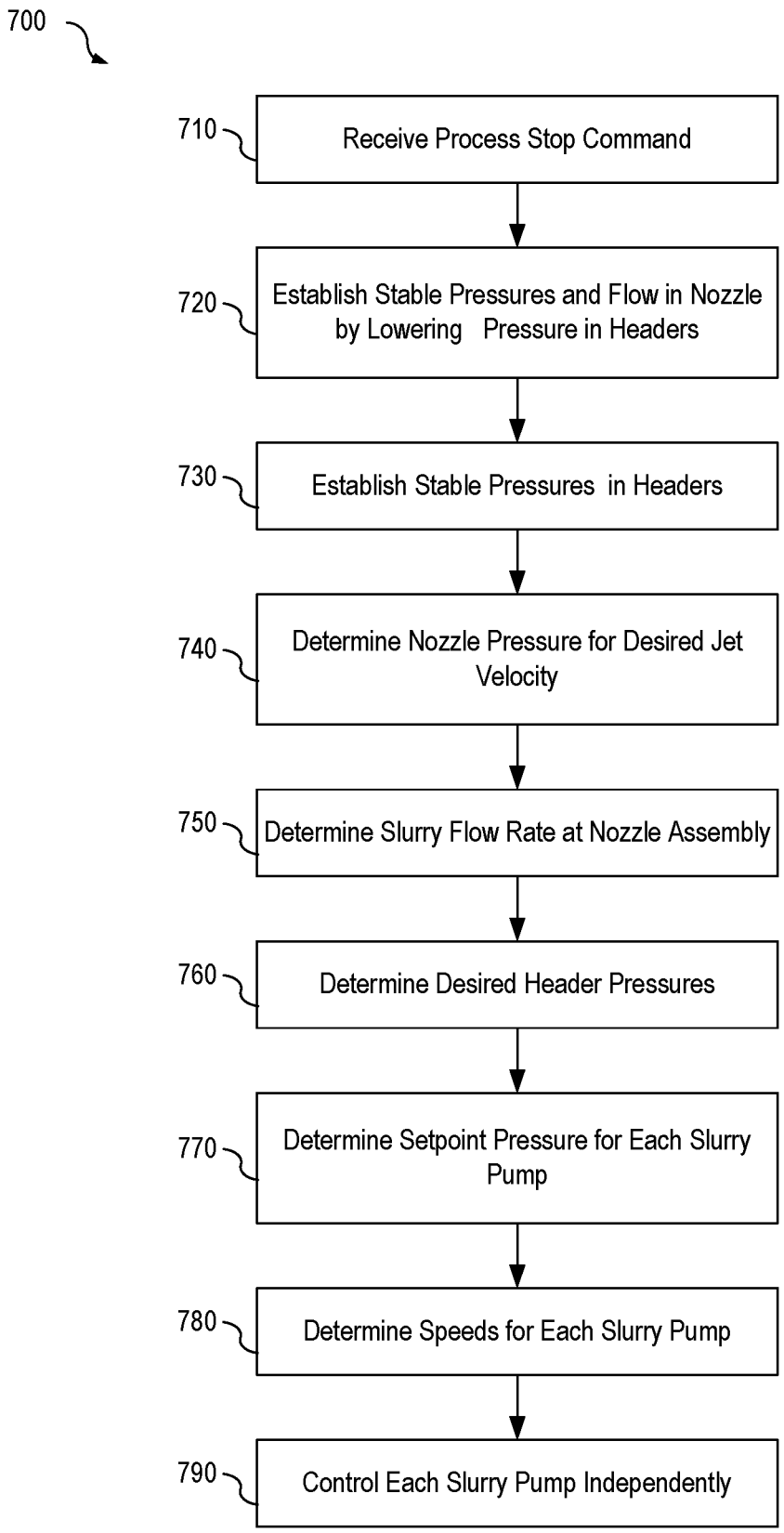
FIG. 7 is a flowchart illustrating an example of a method for controlling the slice flow of a slurry through a headbox for a paper making machine during shutdown operation according to aspects of the present disclosure

FIG. 7 is a flowchart illustrating an example of a method 700 for controlling the slice flow of a slurry through a headbox for a paper making machine during shutdown operation according to aspects of the present disclosure. Referring to FIG. 5 and FIG. 3, at block 710, a process stop command may be received. For example, a stop command may be input via the operator control module.

At block 720, stable flow and pressure in the nozzle may be established. For example, after receiving the stop command, the control system may slowly lower the pressures in the headers to establish a stable specified pressure and specified flow in the nozzle. The pressures in the headers that establish the specified pressure and specified flow in the nozzle may be lower than the operational process pressure. The control system may provide individual control of the speeds of the fan pumps for each header to individually control the pressure in each header. The control system may also control the slice opening to establish the specified flow in the nozzle At block 730, stable pressures in the headers may be established. For example, the control system may cause pressure in the headers (e.g., the cross machine headers 110, 120) to be set to a specified pressure. The specified pressure may be lower than the operational pressure for the process. The control system may provide individual control of the speeds of the fan pumps for each header to individually control the pressure in each header. Upon achieving the specified pressure, the control system may maintain the pressure for a predetermined period of time.

At block 740, the slurry pressure at the nozzle assembly for a desired jet velocity may be determined. A jet velocity setpoint may be input to a nozzle assembly pressure calculation block (e.g., the nozzle assembly pressure calculation block PY-N). The nozzle assembly pressure calculation block may calculate the desired slurry pressure at the nozzle assembly for the desired jet velocity based on the jet velocity setpoint and the slice position determined by a slice position transmitter (e.g., the position transmitter ZT).

At block 750, the slurry flow rate at the nozzle assembly may be determined. The slurry flow rate at the nozzle assembly may be a combined flow rate of two or more different component slurries. A flow calculation block (e.g., the flow calculation block FY-NA) may calculate the slurry flow rate at the nozzle assembly based on the slice position determined by the slice position transmitter (e.g., the position transmitter ZT) and the desired slurry pressure at the nozzle assembly.

At block 760, the desired header pressures may be determined. A header pressure calculation block (e.g., the header pressure calculation block PY-H) may determine the desired header pressures to achieve the desired pressure and flow rate for the slurry at the nozzle assembly. The header pressure calculation block may determine the desired header pressures based on nozzle assembly pressure input from the nozzle assembly pressure calculation block, measured slurry pressure at the nozzle assembly from the nozzle assembly pressure transmitter, and the slurry flow rate calculated by the flow calculation block.

At block 770, setpoint pressures for each slurry pump may be determined. A first pressure calculation block (e.g., the pressure calculation block PY-A) for a first control loop may calculate a pressure setpoint for a first slurry pressure based on a pressure input from the header pressure calculation block. Similarly, a second pressure calculation block (e.g., the pressure calculation block PY-B) for a second control loop may calculate a pressure setpoint for a second slurry pressure based on the pressure input from the header pressure calculation block.

At block 780, speeds for each slurry pump may be determined. A first pressure controller (e.g., the pressure controller PIC-A) may calculate a desired speed for a first slurry pump (e.g., the fan pump A) for the first slurry based on the pressure setpoint input from the first pressure calculation block and a measured header pressure input from a first header pressure transmitter (e.g., the header pressure transmitter PT-Ahh) for the first slurry. Similarly, a second pressure controller (e.g., the pressure controller PIC-B) may calculate a desired speed for a second slurry pump (e.g., the fan pump B) for the second slurry based on the pressure setpoint input from the second pressure calculation block and a measured header pressure input from a second header pressure transmitter (e.g., the header pressure transmitter PT-Bhh) for the second slurry.

At block 790, each slurry pump may be independently controlled. The first pressure controller may output the desired pump speed for the first slurry pump to the first speed controller (e.g., the speed controller SC-A) for the first control loop. The first speed controller may control the speed of the first slurry pump to achieve the desired header pressure for the first slurry. Similarly, the second pressure controller may output the desired pump speed for the second slurry pump to the second speed controller (e.g., the speed controller SC-B) for the second control loop. The second speed controller may control the speed of the second slurry pump to achieve the desired header pressure for the second slurry. Thus, the header pressure for each slurry is independently controlled by the separate control loops.

Independent control of the header pressures of the first and second slurries can provide control of the of the slurry flow rate through the nozzle assembly while maintaining a slurry ratio and achieving the desired jet velocity at the headbox slice. Further, the nozzle assembly may be filled with the slurries while the header pressure for each slurry is controlled.

The specific operations illustrated in FIG. 7 provide a particular method for controlling the slice flow of a slurry through a headbox for a paper making machine during shutdown operation according to an embodiment of the present disclosure. Other sequences of operations may also be performed according to alternative embodiments. For example, alternative embodiments of the present disclosure may perform the operations outlined above in a different order. Moreover, the individual operations illustrated in FIG. 7 may include multiple sub-operations that may be performed in various sequences as appropriate to the individual operation. Furthermore, additional operations may be added or removed depending on the particular applications.

While the example of the method 700 has been explained using two slurry components for ease of explanation, more than two slurry components may be used without departing from the scope of the present disclosure.

The method 700, may be embodied on a non-transitory computer readable medium known to those of skill in the art, having stored therein a program including computer executable instructions for making a processor, computer, or other programmable device execute the operations of the methods.

The examples and embodiments described herein are for illustrative purposes only. Various modifications or changes in light thereof will be apparent to persons skilled in the art. These are to be included within the spirit and purview of this application, and the scope of the appended claims, which follow.

What is claimed is:

1. A method for controlling a slice flow of a slurry having two or more component slurries through a headbox for a paper making machine, the method comprising:

inputting a wire speed of the paper making machine or a ratio of a jet velocity to the wire speed of the paper making machine;

determining a jet velocity setpoint based on the wire speed of the paper making machine or the ratio of the jet velocity to the wire speed of the paper making machine;

determining a header pressure setpoint for two or more headers to generate the jet velocity determined by the jet velocity setpoint, each header providing one of the two or more component slurries to the headbox;

during a startup operation:

establishing a first pressure in the two or more headers, the first pressure being lower than an operational pressure, wherein the first pressure establishes a specified nozzle pressure and a specified slurry flow in a nozzle assembly of the headbox; and controlling the slice flow by:

generating a first speed command to a first slurry pump to generate a header pressure determined by the header pressure setpoint in a first header; and generating a second speed command to a second slurry pump to generate the header pressure determined by the header pressure setpoint in a second header.

2. The method of claim 1, further comprising:

determining a setpoint for a slurry flow rate at a nozzle assembly of the headbox; and measuring a slurry pressure at the nozzle assembly, wherein the header pressure setpoint for the two or more headers is based on the slurry flow rate at the nozzle assembly, the jet velocity setpoint, and a measured pressure at the nozzle assembly.

3. The method of claim 2, further comprising:

measuring the header pressure, wherein the slurry flow rate in the nozzle assembly is determined based on the measured slurry pressure at the nozzle assembly, the measured header pressure, and a slice position of the nozzle assembly.

4. The method of claim 1, wherein:

the first speed command for the first slurry pump is generated based on the header pressure setpoint and a measured header pressure for the first header, and the second speed command for the second slurry pump is generated based on the header pressure setpoint and a measured header pressure for the second header.

5. The method of claim 1, further comprising:

during a process shutdown operation:

decreasing pressure in the two or more headers to a first pressure lower than an operational pressure for the process, wherein the first pressure establishes a specified nozzle pressure and a specified slurry flow in a nozzle assembly of the headbox; and establishing a second pressure in the two or more headers, the second pressure being lower than the first pressure.

6. The method of claim 1, wherein determining a jet velocity setpoint further comprises:

measuring a slice position of a nozzle assembly of the headbox; and combining the measured slice position with the input of the wire speed of the paper making machine or the ratio of the jet velocity to the wire speed of the paper making machine.

7. A control system for controlling a slice flow of a slurry having two or more component slurries through a headbox for a paper making machine, the control system comprising:

an operator control module configured to receive input instructions;

pressure transmitters configured to transmit measured slurry pressures;

flow transmitters configured to transmit measured slurry flow rates;

pressure controllers configured to control slurry pressures;

speed controllers configured to control speeds of slurry pumps; and a processor in communication with the operator control module, the pressure controllers and speed controllers, the processor configured to:

receive a wire speed of the paper making machine or a ratio of a jet velocity to the wire speed of the paper making machine from the operator control module;

determine a jet velocity setpoint based on the wire speed of the paper making machine or the ratio of the jet velocity to the wire speed of the paper making machine;

determine a header pressure setpoint for two or more headers to generate the jet velocity determined by the jet velocity setpoint, each header providing one of the two or more component slurries to the headbox;

during a startup operation:

establish a first pressure in the two or more headers, the first pressure being lower than an operational pressure, wherein the first pressure establishes a specified nozzle pressure and a specified slurry flow in a nozzle assembly of the headbox; and control the slice flow by:

causing a first pressure controller to generate a first speed command to a first speed controller for a first slurry pump to generate a header pressure determined by the header pressure setpoint in a first header; and causing a second pressure controller to generate a second speed command to a second speed controller for a second slurry pump to generate the header pressure determined by the header pressure setpoint in a second header.

8. The control system of claim 7, wherein the processor is further configured to:

receive a slurry flow rate measurement from a flow transmitter and determine a setpoint for a slurry flow rate at a nozzle assembly of the headbox;

receive a slurry pressure measurement at the nozzle assembly from a nozzle pressure transmitter; and determine the header pressure setpoint for the two or more headers based on the slurry flow rate at the nozzle assembly, the jet velocity setpoint, and the measured pressure at the nozzle assembly.

9. The control system of claim 8, wherein the processor is further configured to:

receive a header pressure measurement from a header pressure transmitter; and determine the slurry flow rate in the nozzle assembly based on the measured slurry pressure at the nozzle assembly, the measured header pressure, and a slice position of the nozzle assembly.

10. The control system of claim 7, wherein:

the first speed command for the first slurry pump is generated based on the header pressure setpoint and a measured header pressure for the first header, and the second speed command for the second slurry pump is generated based on the header pressure setpoint and a measured header pressure for the second header.

11. The control system of claim 7, wherein during a process shutdown operation the processor is further configured to:

decrease pressure in the two or more headers to a first pressure lower than an operational pressure for the process, wherein the first pressure establishes a specified nozzle pressure and a specified slurry flow in a nozzle assembly of the headbox; and establish a second pressure in the two or more headers, the second pressure being lower than the first pressure.

12. The control system of claim 7, wherein further configured to determine the jet velocity setpoint by:

receiving a slice position measurement of a nozzle assembly of the headbox from a position transmitter; and combining the measured slice position with the received wire speed of the paper making machine or the ratio of the jet velocity to the wire speed of the paper making machine.

13. A non-transitory computer readable medium having stored therein instructions for making one or more processors execute a method for controlling a slice flow of a slurry having two or more component slurries through a headbox for a paper making machine, the processor executable instructions comprising instructions for performing operations including:

receiving a wire speed of the paper making machine or a ratio of a jet velocity to the wire speed of the paper making machine from an operator control module;

determining a jet velocity setpoint based on the wire speed of the paper making machine or the ratio of the jet velocity to the wire speed of the paper making machine;

determining a header pressure setpoint for two or more headers to generate the jet velocity determined by the jet velocity setpoint, each header providing one of the two or more component slurries to the headbox;

during a startup operation:

establishing a first pressure in the two or more headers, the first pressure being lower than an operational pressure, wherein the first pressure establishes a specified nozzle pressure and a specified slurry flow in a nozzle assembly of the headbox; and controlling the slice flow by:

causing a first pressure controller to generate a first speed command to a first speed controller for a first slurry pump to generate a header pressure determined by the header pressure setpoint in a first header; and causing a second pressure controller to generate a second speed command to a second speed controller for a second slurry pump to generate the header pressure determined by the header pressure setpoint in a second header.

14. The non-transitory computer readable medium as defined in claim 13, further comprising instruction for performing operations including:

receiving a slurry flow rate measurement from a flow transmitter and determining a setpoint for a slurry flow rate at a nozzle assembly of the headbox;

receiving a slurry pressure measurement at the nozzle assembly from a nozzle pressure transmitter; and determining the header pressure setpoint for the two or more headers based on the slurry flow rate at the nozzle assembly, the jet velocity setpoint, and the measured pressure at the nozzle assembly.

15. The non-transitory computer readable medium as defined in claim 14, further comprising instruction for performing operations including:

receiving a header pressure measurement from a header pressure transmitter; and determining the slurry flow rate in the nozzle assembly based on the measured slurry pressure at the nozzle assembly, the measured header pressure, and a slice position of the nozzle assembly.

16. The non-transitory computer readable medium as defined in claim 13, wherein:

the first speed command for the first slurry pump is generated based on the header pressure setpoint and a measured header pressure for the first header, and the second speed command for the second slurry pump is generated based on the header pressure setpoint and a measured header pressure for the second header.

17. The non-transitory computer readable medium as defined in claim 13, further comprising instruction for performing operations including:

determining the jet velocity setpoint by:

receiving a slice position measurement of a nozzle assembly of the headbox from a position transmitter; and combining the measured slice position with the received wire speed of the paper making machine or the ratio of the jet velocity to the wire speed of the paper making machine.

* * * * *